US006893329B2

(12) United States Patent
Tajima et al.

(10) Patent No.: US 6,893,329 B2
(45) Date of Patent: May 17, 2005

(54) POLISHING APPARATUS WITH ABRASIVE TAPE, POLISHING METHOD USING ABRASIVE TAPE AND MANUFACTURING METHOD FOR MAGNETIC DISK

(75) Inventors: Fujio Tajima, Hiratsuka (JP); Hideaki Amano, Odawara (JP); Teruaki Tokutomi, Odawara (JP); Takahisa Ishida, Hadano (JP); Kazuyuki Sonobe, Ninomiya-machi (JP); Yasunori Fukuyama, Odawara (JP); Tsutomu Nagakura, Hadano (JP); Noritake Shizawa, Ninomiya-machi (JP); Takeshi Sato, Ninomiya-machi (JP)

(73) Assignee: Hitachi High-Tech Electronics Engineering Co., Ltd., Tokyo (JP)

( * ) Notice: Subject to any disclaimer, the term of this patent is extended or adjusted under 35 U.S.C. 154(b) by 0 days.

(21) Appl. No.: 10/656,926

(22) Filed: Sep. 5, 2003

(65) Prior Publication Data

US 2004/0198181 A1 Oct. 7, 2004

(30) Foreign Application Priority Data

Mar. 17, 2003 (JP) ..... P 2003-071613

(51) Int. Cl.[7] ..... B24B 1/00

(52) U.S. Cl. ..... 451/41; 451/296; 451/301; 451/303; 451/306; 451/307; 451/310; 451/311

(58) Field of Search ..... 451/41, 296, 301, 451/303, 306, 307, 310, 311

(56) References Cited

U.S. PATENT DOCUMENTS

| | | | | |
|---|---|---|---|---|
| 3,971,163 A | * | 7/1976 | Trombley et al. | 451/163 |
| 5,018,311 A | * | 5/1991 | Malagrino et al. | 451/302 |
| 6,129,612 A | * | 10/2000 | Reynen et al. | 451/53 |
| 6,283,838 B1 | * | 9/2001 | Blake et al. | 451/63 |

FOREIGN PATENT DOCUMENTS

| | | | |
|---|---|---|---|
| JP | 02-106264 | 4/1990 | B24B/21/00 |
| JP | 2001-067655 | 3/2001 | G11B/5/84 |
| JP | 2001-071249 | 3/2001 | B24B/21/00 |

* cited by examiner

*Primary Examiner*—Joseph J. Hail, III
*Assistant Examiner*—Shantese McDonald
(74) *Attorney, Agent, or Firm*—Mayer Fortkort & Williams, PC; Karin L. Williams, Esq.; Michael P. Fortkort, Esq.

(57) ABSTRACT

An abrasive tape is supplied to a tape head by a tape supply unit and taken up from the tape head by a tape take-up unit. The tape head presses the abrasive tape against a surface of an object under polish, which is rotated by a rotating unit. A tape head pressuring unit utilizes a voice coil motor, for example. Since the tape head pressuring unit generates a pressuring force for pressuring the tape head using the electromagnetic force, it is able to set a minute pressuring force by controlling a drive signal, and to obtain the fine adjustment of the pressuring force easily by controlling the electric signal. Therefore, it becomes possible to press the abrasive tape against the surface of the object under polish with a desired low pressure.

25 Claims, 8 Drawing Sheets

POLISHING APPARATUS WITH ABRASIVE TAPE, POLISHING METHOD USING ABRASIVE TAPE AND MANUFACTURING METHOD FOR MAGNETIC DISK

FIELD OF THE INVENTION

The present invention relates to a polishing apparatus and a method for polishing an object under polish, which has a very thin surface to be polished, using an abrasive tape, and a manufacturing method for a magnetic disk utilizing them.

BACKGROUND OF THE INVENTION

For a magnetic disk, which is used as an information record medium in a computer, etc., a requirement of the high recording density is becoming greater in recent years; accordingly films formed on surfaces of the magnetic disk, such as magnetic layers and protective films, are becoming thinner.

In a manufacturing process of the magnetic disk, undercoating layers with non-magnetic metal, undercoating layers with metal, the magnetic layers, the protective films, etc. are formed on surfaces of a disk substrate. Then, in order to remove small protrusions generated during these membrane forming processes and in order to clean up the surfaces of the magnetic disk, the tape cleaning is carried out on the surfaces of the magnetic disk by a polishing apparatus. The tape cleaning is to polish the surfaces of the magnetic disk by pressing tape like abrasives against the surfaces of the magnetic disk while the disk is rotating.

In this tape cleaning process, an air pressure or the spring force as described in the Japanese Patent Laid-Open 1990-106264, for example, was conventionally employed for pressing abrasive tapes against the surfaces of the magnetic disk. In an apparatus employing the spring force as described in the Japanese Patent Laid-Open 1990-106264, for example, a pressure for pressing the abrasive tape against the surface of the magnetic disk was approximately 50–75 g. With regard to the polishing apparatus carrying out the tape cleaning, there are also the Japanese Patent Laid-Open 2001-67655 and the Japanese Patent Laid-Open 2001-71249. The Japanese Patent Laid-Open 2001-67655 has a description of "the pressing force is usually 30–200 g, preferably 50–150 g, more preferably 50–100 g". The Japanese Patent Laid-Open 2001-71249 has a description of "10 g, for example".

The thinner the protective film, etc. becomes due to the high recording density, the lower the pressure for pressing the abrasive tape against the surface of the magnetic disk needs to be in order to prevent the damage on the polished protective film, etc. Moreover, a surface position of the magnetic disk moves during a polish due to many factors, such as deformations or waves on the surface of the magnetic disk, a deflection of the surface when the magnetic disk is rotating, assembly alignment errors of the polishing apparatus and a vibration of a spindle that rotates the magnetic disk. In the conventional polishing apparatus employing the air pressure or the spring force, when the surface position of the magnetic disk moves, the pressure for pressing the abrasive tape against the surface of the magnetic disk fluctuates, so that it becomes difficult to polish the surface of the magnetic disk uniformly.

Furthermore, the damage occurs due to the shock when the abrasive tape touches the surface of the magnetic disk, even if the pressure for pressing the abrasive tape against the surface of the magnetic disk is made small in order to prevent the damage on the polished protective film, etc. This is also becoming a problem.

SUMMARY OF THE INVENTION

The present invention is made in view of above-mentioned issues. The purpose of the present invention is to press the abrasive tape against the surface of an object under polish with a desired low pressure.

Another purpose of the present invention is to make a fluctuation of the pressure for pressing the abrasive tape against the surface of the object under polish small, and to polish the surface of the object under polish uniformly.

Another purpose of the present invention is to polish the surface of the object under polish uniformly, even if the surface of the object under polish deflects while polishing with a low pressure for pressing the abrasive tape against the surface of the object under polish.

Another purpose of the present invention is to prevent the damage generated when the abrasive tape touches the surface of the object under polish.

A feature of the present invention is rotating the object under polish, supplying and taking-up the abrasive tape to/from a tape head, and pressing the abrasive tape against the surface of the object under polish by pressuring the tape head using the electromagnetic force. For example, a voice coil motor is utilized in a tape head pressuring unit, which pressures the tape head. Since the tape head pressuring unit generates a pressuring force for pressuring the tape head using the electromagnetic force, it is able to set a minute pressuring force by controlling a drive signal, and to obtain the fine adjustment of the pressuring force easily by controlling the electric signal. Therefore, it becomes possible to press the abrasive tape against the surface of the object under polish with a desired low pressure.

Moreover, the pressuring force generated by the electromagnetic force is constant when the drive signal is fixed, and it does not depend on a position of the tape head or a surface position of the object under polish. The tape head stops at a point where the pressuring force for pressuring the tape head, the reactive force from the surface of the object under polish and the reactive force due to the elasticity of the tape head are balanced. When the surface position of the object under polish will move, the tape head will follow it and stop at a newly balanced point. Therefore, a movement of the surface position of the object under polish will be absorbed, so that it becomes possible to make the fluctuation of the pressure, with which the tape head presses the abrasive tape against the surface of the object under polish, small, and to polish the surface of the object under polish uniformly.

Another feature of the present invention is rotating the object under polish, supplying the abrasive tape to a tape head, driving a voice coil motor by generating a signal indicating a target pressuring force so as to pressure the tape head by the voice coil motor, detecting a pressuring force of the voice coil motor, and pressing the abrasive tape against the surface of the object under polish by controlling the voice coil motor with a pressure detection signal fed back to the signal indicating the target pressuring force. For example, a load cell is mounted between the voice coil motor and the tape head for detecting the pressuring force of the voice coil motor. Since the voice coil motor is controlled by feeding the pressure detection signal back to the signal indicating the target pressure, even if the surface of the object under polish deflects, the pressuring force of the voice coil motor is finely adjusted in response to a deflection by the feedback control. Therefore, it becomes possible to polish the surface of the object under polish uniformly.

Another feature of the present invention is rotating the object under polish, supplying the abrasive tape to a tape head, driving a voice coil motor by generating a signal indicating the first target position so as to move the tape head by the voice coil motor, detecting a position of the tape head, moving the tape head toward the surface of the object under polish and stopping it at a point, which is close to the surface of the object under polish, by controlling the voice coil motor with a position detection signal fed back to the signal indicating the first target position, driving the voice coil motor by generating a signal indicating the second target position so as to move the tape head by the voice coil motor, detecting the position of the tape head, making the abrasive tape to touch the surface of the object under polish by controlling the voice coil motor with the position detection signal fed back to the signal indicating the second target position, driving the voice coil motor by generating a signal indicating a target pressuring force so as to pressure the tape head by the voice coil motor, detecting a pressuring force of the voice coil motor, and pressing the abrasive tape against the surface of the object under polish by controlling the voice coil motor with a pressure detection signal fed back to the signal indicating the target pressuring force. Since the tape head is once stopped at the point, which is close to the surface of the object under polish, and the contact of the abrasive tape and the magnetic disk is carried out softly, it becomes possible to prevent the damage generated when the abrasive tape touches the surface of the object under polish.

DETAILED DESCRIPTION OF PREFERRED EMBODIMENTS

Figure 1:
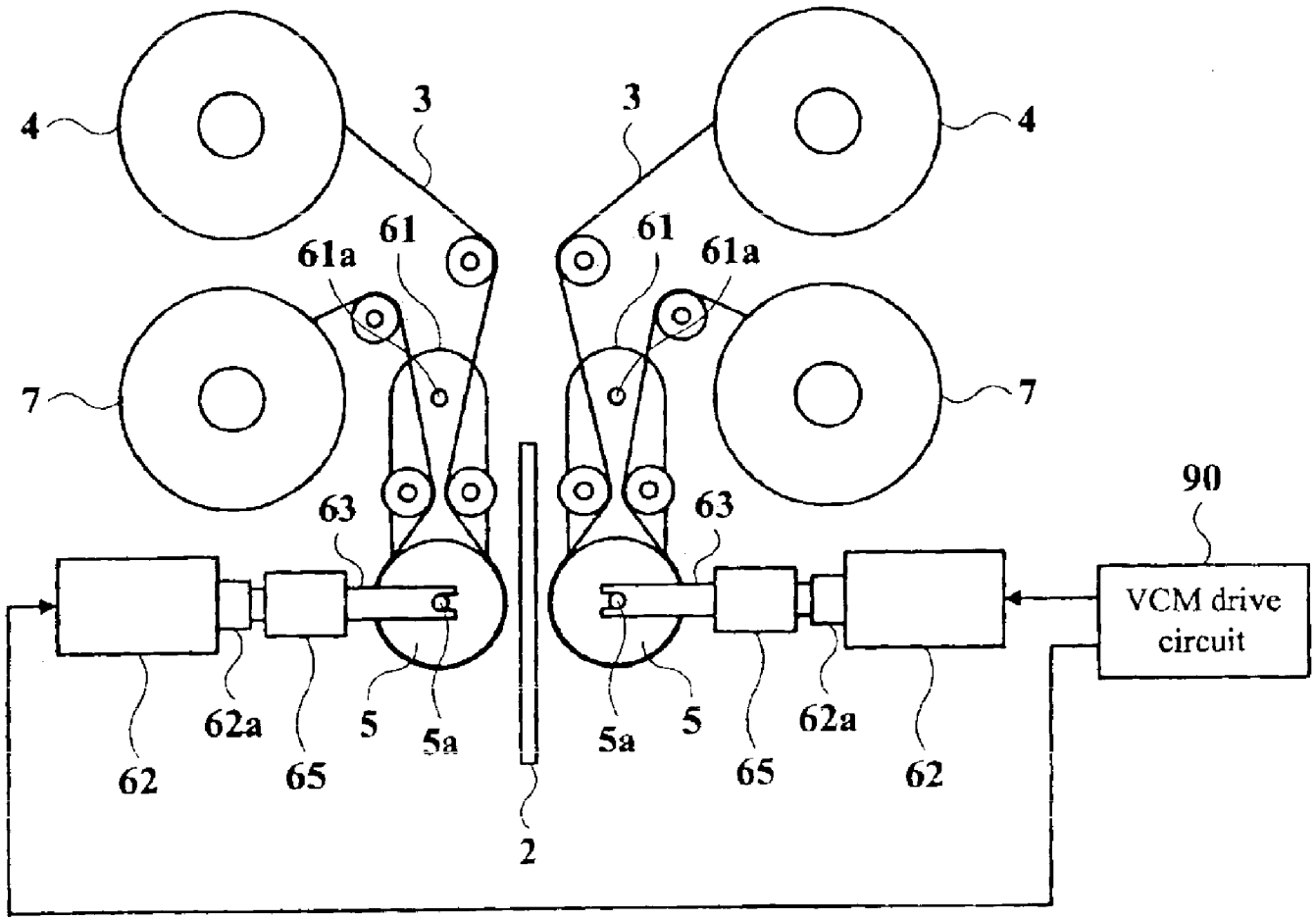
FIG. 1 is a schematic view showing one embodiment of a polishing apparatus according to the present invention.
Figure 2:
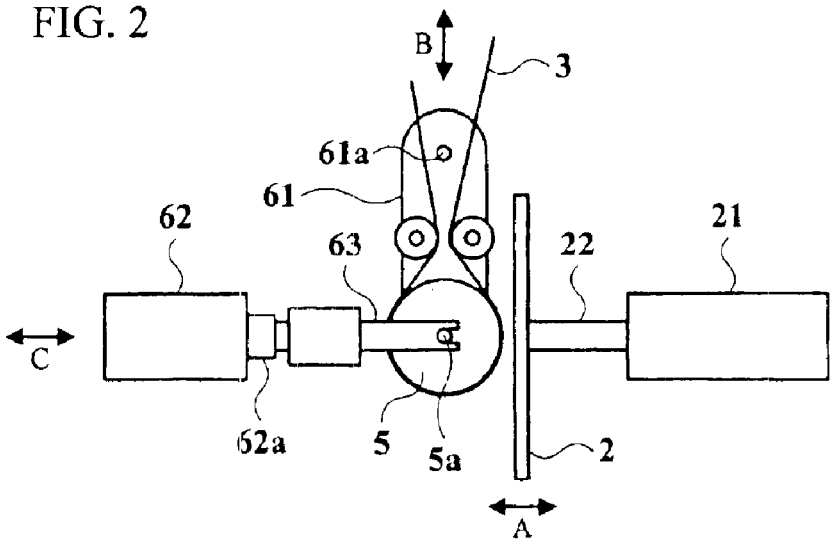
FIG. 2 is a part of the polishing apparatus shown in FIG. 1.

Further details are explained below with the help of examples illustrated in the attached drawings. FIG. 1 is a schematic view showing a first embodiment of a polishing apparatus according to the present invention. FIG. 2 is a part of the polishing apparatus shown in FIG. 1. The polishing apparatus of this example comprises a magnetic disk rotating unit, abrasive tapes 3, tape supply units, tape heads 5, tape head pressuring units, tape take-up units and a VCM (Voice Coil Motor) drive circuit 90. The magnetic disk rotating unit has a motor 21 and a spindle 22. The tape head pressuring units have a swing arm 61, a voice coil motor 62, an arm 63 and a bearing 65. The tape supply units have a supply reel 4 and guide rollers. The tape take-up units have guide rollers and a take-up reel 7.

In FIG. 1, the magnetic disk rotating unit is not seen but located behind the equipment that polishes a right-side surface of a magnetic disk 2. In FIG. 2, on the other hand, illustrations of the equipment that polishes the right-side surface of the magnetic disk 2 is omitted, and the magnetic disk rotating unit located behind it is shown.

In FIG. 2, the magnetic disk 2, which is an object under polish, is attached at an end of the spindle 22. The spindle 22 supports the magnetic disk 2 such that its surfaces to be polished are arranged vertically, and is rotated by the motor 21.

In FIG. 1, the tape head 5 is provided near the surface of the magnetic disk 2 in both sides respectively. The abrasive tapes 3, wherein a base film is coated with abrasive particles, are wound on the supply reels 4. The abrasive tapes 3 are fed from the supply reels 4 to the tape heads 5, which are provided near the surfaces of the magnetic disk 2, through the guide rollers. The tape heads 5 consist of a roller, and axes 5*a* of the rollers are attached on the swing arms 61 that are arranged vertically. The swing arms 61 balance the tape heads 5 by means of gravity, so that the tape heads 5 are supported parallel to the surfaces of the magnetic disk 2. When the swing arms 61 rotate around axes 61*a*, the tape heads 5 move and the abrasive tapes 3 are pressed against the surfaces of the magnetic disk 2. While pressing the abrasive tapes 3 against the both surfaces of the magnetic disk 2 by the tape heads 5 in the both sides, the magnetic disk 2 is rotated by the motor 21 and the abrasive tapes 3 are run by the supply reels 4 and the guide rollers, so that the tape heads 5 rotate and the abrasive tapes 3 polish the both surfaces of the magnetic disk 2 simultaneously. The abrasive tapes 3 are recovered from the tape head 5 by the take-up reels 7 through the other guide rollers, and wound on the take-up reels 7.

The arms 63 are connected to movable portions 62*a* of the voice coil motors 62. The arms 63 are supported movably by the bearings 65, and ends of the arms 63 contact the axes 5*a* of the tape heads 5. When the VCM drive circuit 90 supplies drive currents to the voice coil motors 62, the movable portions 62*a* move due to the electromagnetic force and the arms 63 push the tape heads 5, so that the tape heads 5 press the abrasive tapes 3 against the surfaces of the magnetic disk 2.

Since the voice coil motors 62 generate pressuring forces for pressuring the tape heads 5 using the electromagnetic force, they are able to set minute pressuring forces by controlling the drive currents, and to obtain the fine adjustment of the pressuring forces easily by controlling the electric signals. Therefore, it becomes possible to press the abrasive tapes 3 against the surfaces of the magnetic disk 2 with desired low pressures.

In FIG. 2, a surface position of the magnetic disk 2 moves in the direction indicated by an arrow A due to many factors, such as deformations or waves on the surface of the magnetic disk 2, a deflection of the surface when the magnetic disk 2 is rotating, assembly alignment errors of the polishing apparatus and a vibration of the spindle 22. The pressuring force generated by the electromagnetic force in the voice coil motor 62 is constant when the drive current is fixed, and it does not depend on a position of the tape head 5 or the surface position of the magnetic disk 2. The tape head 5 stops at a point where the pressuring force from the voice coil motor 62, the reactive force from the surface of the magnetic disk 2 and the reactive force due to the elasticity of the tape head 5 are balanced. When the surface position of the magnetic disk 2 will move, the tape head 5 will follow it and stop at a newly balanced point. Therefore, a movement of the surface position of the magnetic disk 2 will be absorbed, so that it becomes possible to make a fluctuation of a pressure, with which the tape head 5 presses the abrasive tape 3 against the surface of the magnetic disk 2, small, and to polish the surface of the magnetic disk 2 uniformly.

Moreover, in FIG. 2, the tension is applied to the running abrasive tape 3 in the direction indicated by an arrow B. In this example, the pressuring force is applied to the tape head 5 in the direction indicated by an arrow C as shown in FIG. 2, so that the direction of the tension applied to the abrasive tape 3 and the direction of the pressuring force are almost right-angled. Therefore, according to this example, the pressuring force applied to the tape head 5 has no influence from the tension applied to the abrasive tape 3, and it becomes possible to stabilize the pressure, with which the tape head 5 presses the abrasive tape 3 against the surface of the magnetic disk 2.

Furthermore, according to this example, since the abrasive tape 3 is pressed against the surface of the magnetic disk 2 by the tape head 5 that consists of a roller, the tape head 5 helps the abrasive tape 3 to run, and it becomes easy to supply the abrasive tape 3.

Furthermore, according to this example, since the magnetic disk 2 is supported by the spindle 22 such that the surface to be polished are arranged vertically, polish wastes generated from the surface to be polished drop from there, and it becomes possible to prevent the deposition of the polish wastes on the surface to be polished.

Furthermore, according to this example, since the swing arm 61 balances the tape head 5 by means of gravity such that the tape head 5 is supported parallel to the surface of the magnetic disk 2, and the tape head 5 is moved in the direction of pressing the abrasive tape 3 against the surface of the magnetic disk 2 when the swing arm 61 rotates, it becomes possible to support the tape head 5 movably by a simple component as the swing arm 61. Although, the arm 63 pushes the axis 5*a* of the tape head 5 in this example, other portions of the tape head 5 or the swing arm 61 may be pushed.

Figure 3:
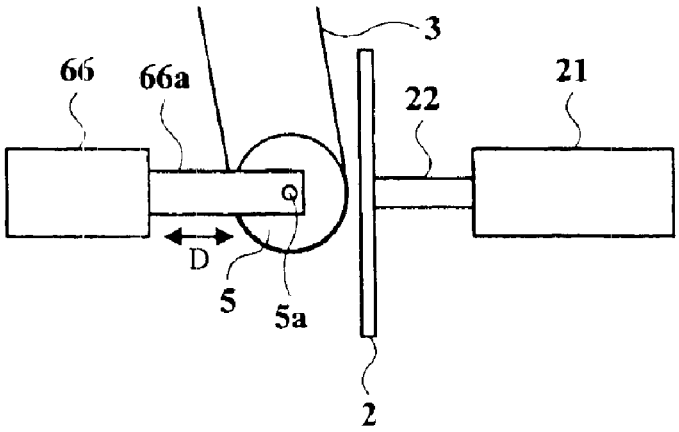
FIG. 3 is a part of another embodiment of a polishing apparatus according to the present invention.

FIG. 3 is a part of another embodiment of the polishing apparatus according to the present invention. In this example, a feature different from the example shown in FIG. 1 is that the tape head pressuring unit does not utilize the swing arm 61 but utilizes a linear-type voice coil motor 66 for supporting the tape head 5. Other elements are the same as those of the example shown in FIG. 1. The axis 5*a* of the tape head 5 is directly connected to a movable portion 66*a* of the linear-type voice coil motors 66 whose movable portion 66*a* moves straight. The tape head 5 moves in the direction indicated by an arrow D when the linear-type voice coil motor 66 is driven.

According to this embodiment, since the tape head 5 is connected to the movable portion 66*a* of the linear-type voice coil motor 66, the swing arm and the like is unnecessary, so that the structure becomes simple.

Figure 4:
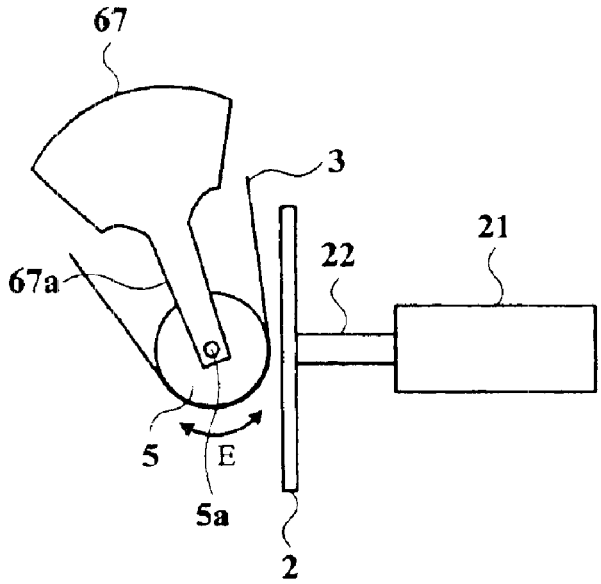
FIG. 4 is a part of another embodiment of a polishing apparatus according to the present invention.

FIG. 4 is a part of another embodiment of the polishing apparatus according to the present invention. In this example, a feature different from the embodiment shown in FIG. 1 is that the tape head pressuring unit does not utilize the swing arm 61 but utilizes a rotary-type voice coil motor 67 for supporting the tape head 5. Other elements are the same as those of the embodiment shown in FIG. 1. The axis 5*a* of the tape head 5 is directly connected to a movable portion 67*a* of the rotary-type voice coil motors 67 whose movable portion 67*a* rotates. The tape head 5 moves in the direction indicated by an arrow E when the rotary-type voice coil motor 67 is driven.

According to this embodiment, since the tape head 5 is connected to the movable portion 67*a* of the rotary-type voice coil motor 67, the swing arm and the like is unnecessary, so that the structure becomes simple, and the equipment becomes small comparing with the equipment utilizing the linear-type voice coil motor.

Figure 5:
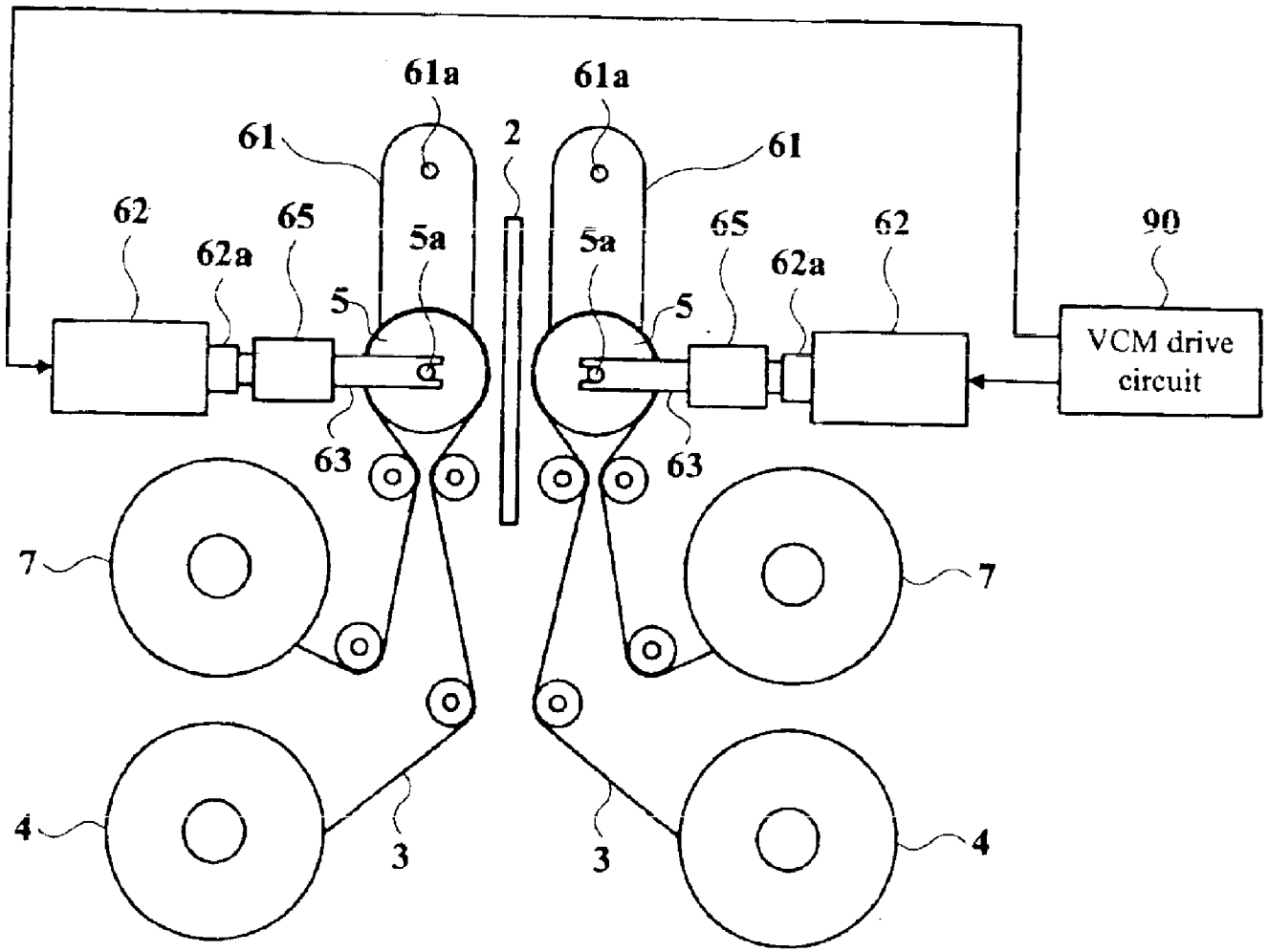
FIG. 5 is a schematic view showing another embodiment of a polishing apparatus according to the present invention.

FIG. 5 is a schematic view showing another embodiment of the polishing apparatus according to the present invention. In this embodiment, a feature different from the embodiment shown in FIG. 1 is that the tape supply units, which have the supply reel 4 and the guide rollers, and the tape take-up units, which have the guide rollers and the take-up reel 7, are located below a rotation axis of the magnetic disc 2.

The polish wastes adhere to the abrasive tapes 3 after polish. If the abrasive tapes 3 are recovered above the magnetic disk 2, the polish wastes removed from the abrasive tapes 3 will float in the air near the surfaces to be polished. However, according to this embodiment, since the abrasive tapes 3 are recovered below the magnetic disk 2 by the recovery reels 7, it becomes possible to prevent the flotation of the polish wastes removed from the abrasive tapes 3 in the air near the surfaces to be polished. Although both the tape supply units and the tape take-up units are located below the magnetic disk 2 in this example, the tape supply units may be located above the magnetic disk 2 and only the tape take-up units may be located below the magnetic disk 2.

In the polishing apparatuses according to the embodiments explained above, it is required to rotate the magnetic disk 2 at high speed in order to improve the throughput. However, when a high-speed rotation of the magnetic disk 2 will be carried out to some extent, the voice coil motors will resonate to vibrations caused by many factors, such as deflections of the surfaces of the magnetic disk 2, etc., and mechanical vibrations will occur in the voice coil motors. Once the mechanical vibrations occur in the voice coil motors, the pressures, with which the tape heads 5 press the abrasive tapes 3 against the surfaces of the magnetic disk 2, will fluctuate.

Figure 6:
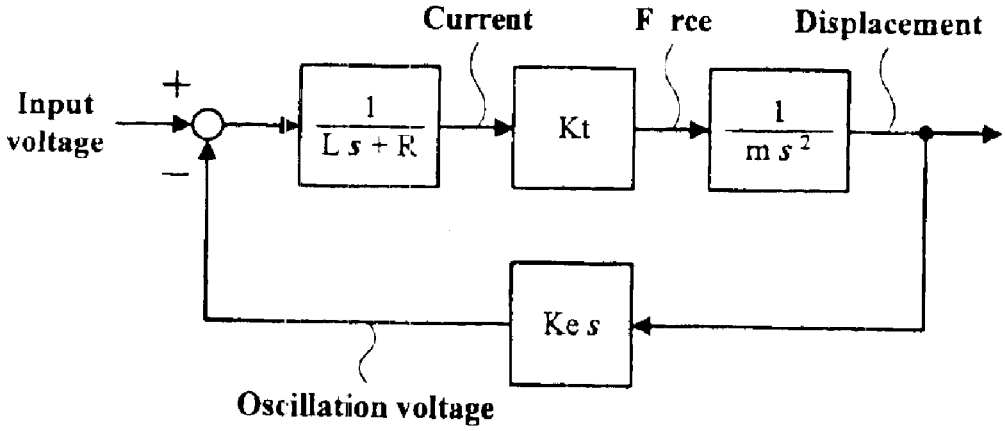
FIG. 6 is a block diagram showing an operation inside the voice coil motor of the polishing apparatus according to the present invention when the voice coil motor is driven with a certain voltage.

FIG. 6 is a block diagram showing an operation inside the voice coil motor of the polishing apparatus according to the present invention when the voice coil motor is driven with a certain voltage. In this case, the voice coil motors 62 shown in FIG. 1 are driven by supplying certain voltages to them from the VCM drive circuit 90.

Inside the voice coil motor 62, as shown in FIG. 6, an input voltage is first transformed into a current by an inductance L and a resistance R of a coil inside the voice coil motor 62. Then, the pressuring force is generated by multiplying the current by the torque constant Kt. Dividing the pressuring force by the total mass of the movable portion and a load of the voice coil motor 62 gives the acceleration, the acceleration is integrated into a speed, and the speed is further integrated into a displacement. When the vibration caused by the resonance is added to this displacement, the counterelectromotive force arises at the coil inside the voice coil motor 62, which is driven with a certain voltage. Differentiating the displacement gives a speed, then an oscillation voltage is generated by multiplying the speed by the power generation constant Ke, as shown in FIG. 6, and the oscillation energy is consumed as the heat.

According to this embodiment, the oscillation energy of the voice coil motor 62 can be consumed as the heat, and the mechanical vibration can be attenuated. Therefore, it becomes possible to stabilize the pressure, with which the tape head 5 presses the abrasive tape 3 against the surface of the magnetic disk 2, and to polish the magnetic disk 2 while rotating it at high speed.

Figure 7:
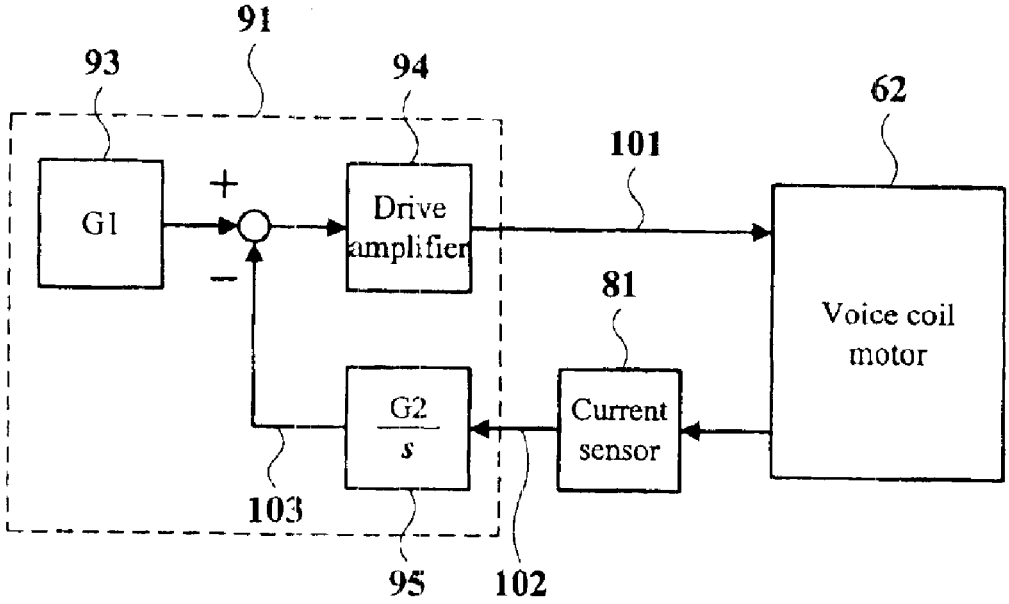
FIG. 7 is a block diagram showing one embodiment of a control circuit of a polishing apparatus according to the present invention.

FIG. 7 is a block diagram showing an embodiment of a control circuit of the polishing apparatus according to the present invention. In this example, a current sensor 81, which measures a current in the voice coil motor 62, is further provided to the example shown in FIG. 1, and a control circuit 91, which controls the voice coil motor 62, is provided instead of the VCM drive circuit.

The control circuit 91 sets the pressuring force of the voice coil motor 62 with a gain G1 of a setting circuit 93 and supplies an electric signal 101 to the voice coil motor 62 through a drive amplifier 94. The electric signal 101 causes the voice coil motor 62 to generate a certain pressuring force, and it is a current in this example. On the other hand, the current sensor 81 measures the current that flows into the coil of the voice coil motor 62. When the mechanical vibration occurs in the voice coil motor 62, a detection signal 102 from the current sensor 81 includes the information showing the amplitude, frequency, etc. of the vibration. Therefore, the current sensor 81 detects the vibration of the voice coil motor 62 by measuring the current that flows into the coil of the voice coil motor 62.

The detection signal 102 from the current sensor 81 is fed back to the control circuit 91, and the electric signal 101 supplied to the voice coil motor 62 is adjusted depending on the detection signal 102. In this example, the detection signal 102 fed back to the control circuit 91 is integrated and amplified with a gain G2 in an adjustment circuit 95, and a speed element 103 is obtained. This speed element 103 plays a role of attenuating the mechanical vibration of the voice coil motor 62 by negating a part of the output from the setting circuit 93.

According to this embodiment, it becomes possible to attenuate the mechanical vibration of the voice coil motor 62 by detecting the vibration of the voice coil motor 62 and feeding them back to the electric signal 101 that causes the pressuring force. Therefore, it becomes possible to stabilize the pressure, with which the tape head 5 presses the abrasive tape 3 against the surface of the magnetic disk 2, and to polish the magnetic disk 2 while rotating it at high speed. Moreover, comparing with the example shown in FIG. 6, the attenuation effect of the mechanical vibration can be improved by adjusting the gain G2 of the adjustment circuit 95 or the like.

Figure 8:
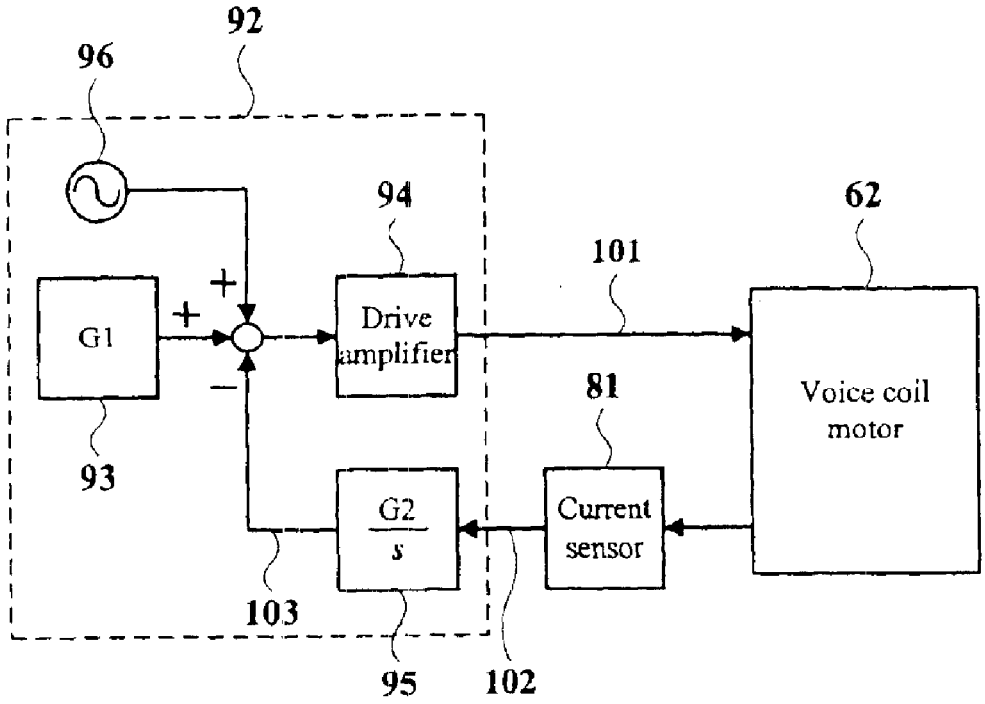
FIG. 8 is a block diagram showing another example of the control circuit of the polishing apparatus according to the present invention.

FIG. 8 is a block diagram showing another embodiment of the control circuit of the polishing apparatus according to the present invention. In this example, a feature different from the example shown in FIG. 7 is that a control circuit 92 has a high frequency signal generator 96. A high frequency signal generated by the high frequency signal generator 96 is added to the output of the setting circuit 93, so that a high frequency signal is included in the electric signal 101 supplied to the voice coil motor 62 from the drive amplifier 94.

According to this embodiment, since the high frequency signal is included in the electric signal 101, the pressuring force generated by the voice coil motor 62 includes a high frequency element, and the pressure, with which the tape head 5 presses the abrasive tape 3 against the surface of the magnetic disk 2, changes at high frequency, so that the polish performance improves.

Figure 9:
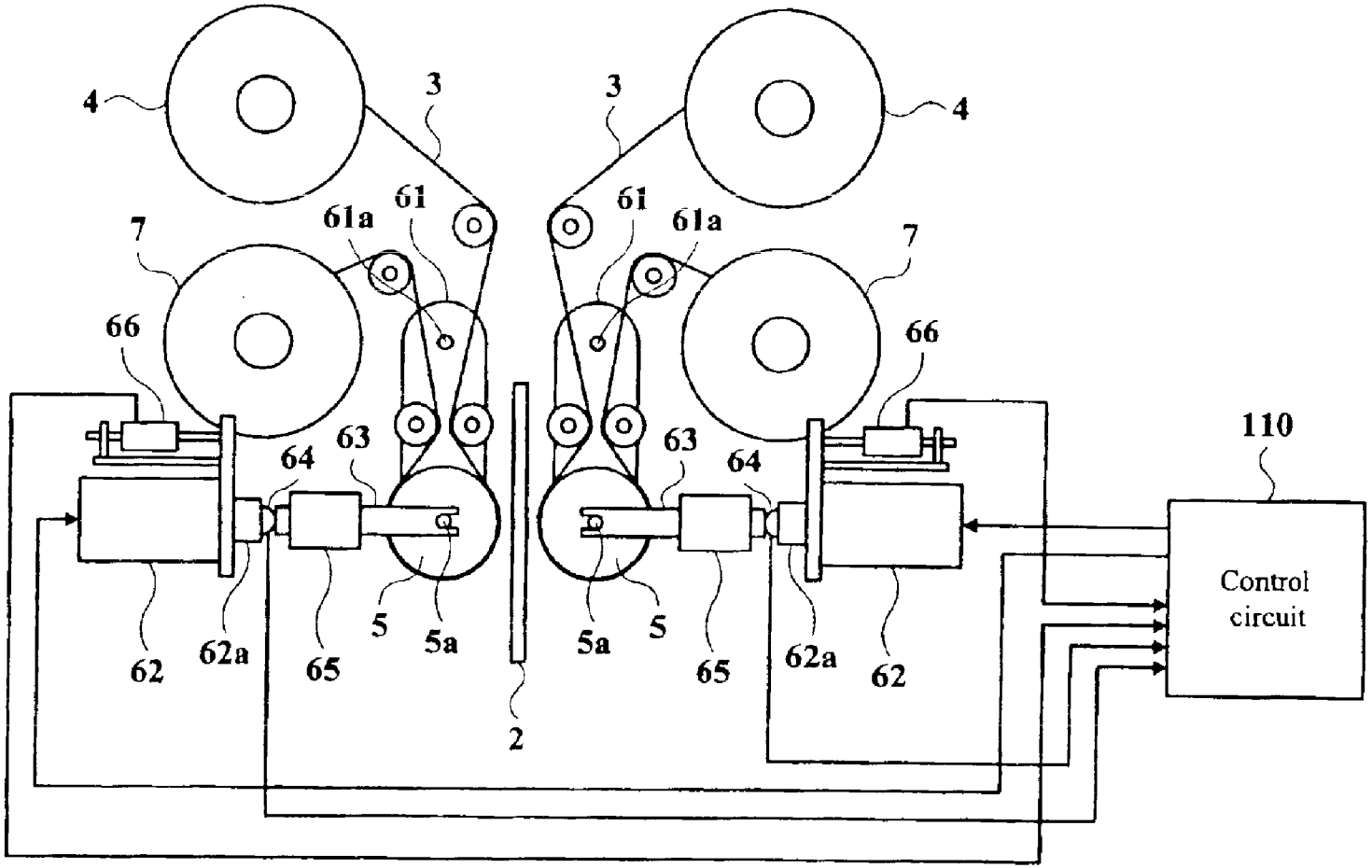
FIG. 9 is a schematic view showing another embodiment of a polishing apparatus according to the present invention.

FIG. 9 is a schematic view showing another embodiment of the polishing apparatus according to the present invention. The polishing apparatus of this embodiment comprises a magnetic disk rotating unit, abrasive tapes 3, tape supply units, tape heads 5, tape head pressuring units, tape take-up units, load cells 64, linear displacement sensors 66 and a control circuit 110. The magnetic disk rotating unit, which has a motor and a spindle, is not seen just like FIG. 1. The tape head pressuring units have a swing arm 61, a voice coil motor 62, an arm 63 and a bearing 65. The tape supply units have a supply reel 4 and guide rollers. The tape take-up units have guide rollers and a take-up reel 7. Operations of the magnetic disk rotating unit, the abrasive tapes 3, the tape supply units, the tape heads 5, the tape head pressuring units and the tape take-up units are the same as those of the emdodiment shown in FIG. 1.

In FIG. 9, the load cells 64 are mounted between movable portions 62*a* of the voice coil motors 62 and the arms 63. The load cells 64 are pressure sensors detecting pressuring forces, with which the voice coil motors 62 pressure the tape heads 5. Moreover, the linear displacement sensors 66 are connected to the movable portions 62*a* of the voice coil motors 62. The linear displacement sensors 66, which generate two signals of different frequencies using magnets and coils inside and detect minute displacements by a phase difference between them, here act as poison sensors detecting positions of the tape heads 5.

When the control circuit 110 supplies drive currents to the voice coil motors 62, the movable portions 62*a* move due to the electromagnetic force and the arms 63 push the tape heads 5, so that the tape heads 5 bring the abrasive tapes 3 close to the surfaces of the magnetic disk 2. At this time, the linear displacement sensors 66 detect the positions of the tape heads 5, and position detection signals from the linear displacement sensors 66 are input to the control circuit 110. The control circuit 110 carries out the feedback control depending on the position detection signals from the linear displacement sensors 66 and adjusts the drive currents supplied to the voice coil motors 62, so that the voice coil motors 62 make the abrasive tapes 3 to touch the surfaces of the magnetic disk 2.

If the voice coil motors 62 are driven with linear ramp currents (or linear ramp voltages) when making the abrasive tapes 3 to touch the surfaces of the magnetic disk 2, there will be a high risk of damaging the magnetic disk 2 due to the inertia of the tape heads 5 since fixed pressures are applied to the tape heads 5. Moreover, since the tape heads 5 and the magnetic disk 2 have the inertia, it is difficult to adjust shock pressures when the abrasive tapes 3 touch the rotating magnetic disk 2 only by adjusting waveforms of the drive signals. For this reason, in this example, the tape heads 5 are stopped once just before the magnetic disk 2, then the tape heads 5 are positioned such that the abrasive tapes 3 touch the surfaces of the magnetic disk 2.

When the control circuit 110 further supplies the drive currents to the voice coil motors 62, the movable portions 62*a* move due to the electromagnetic force and the arms 63 push the tape heads 5, so that the tape heads 5 press the abrasive tapes 3 against the surfaces of the magnetic disk 2. At this time, the load cells 64 detect pressuring forces of the voice coil motors 64, and pressure detection signals from the load cells 64 are input to the control circuit 110. The control circuit 110 carries out the feedback control depending on the pressure detection signals from the load cells 64 and adjusts the drive currents supplied to the voice coil motors 62, so that the voice coil motors 62 gradually raise the pressuring forces and keep them after they become target pressures. Therefore, it becomes possible to stably carry out the fine adjustment of the pressuring forces of the voice coil motors 62, in other words, the load control for the magnetic disk 2.

Figure 11:
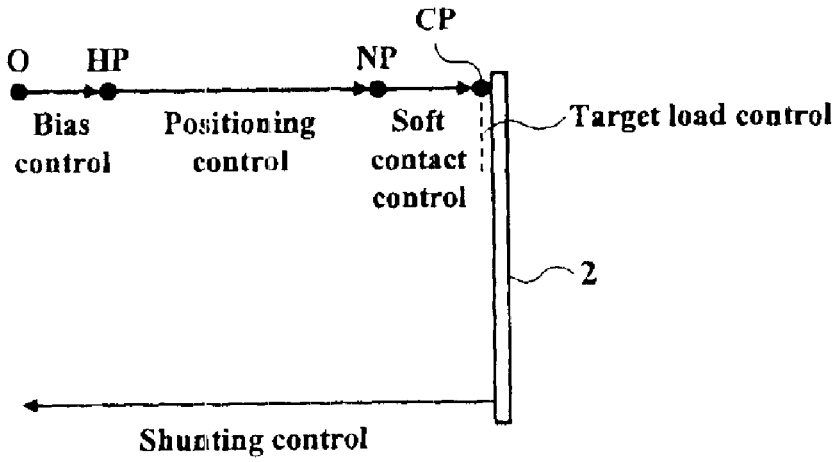
FIG. 11 shows an operation sequence of the control circuit shown in FIG. 10.
Figure 10:
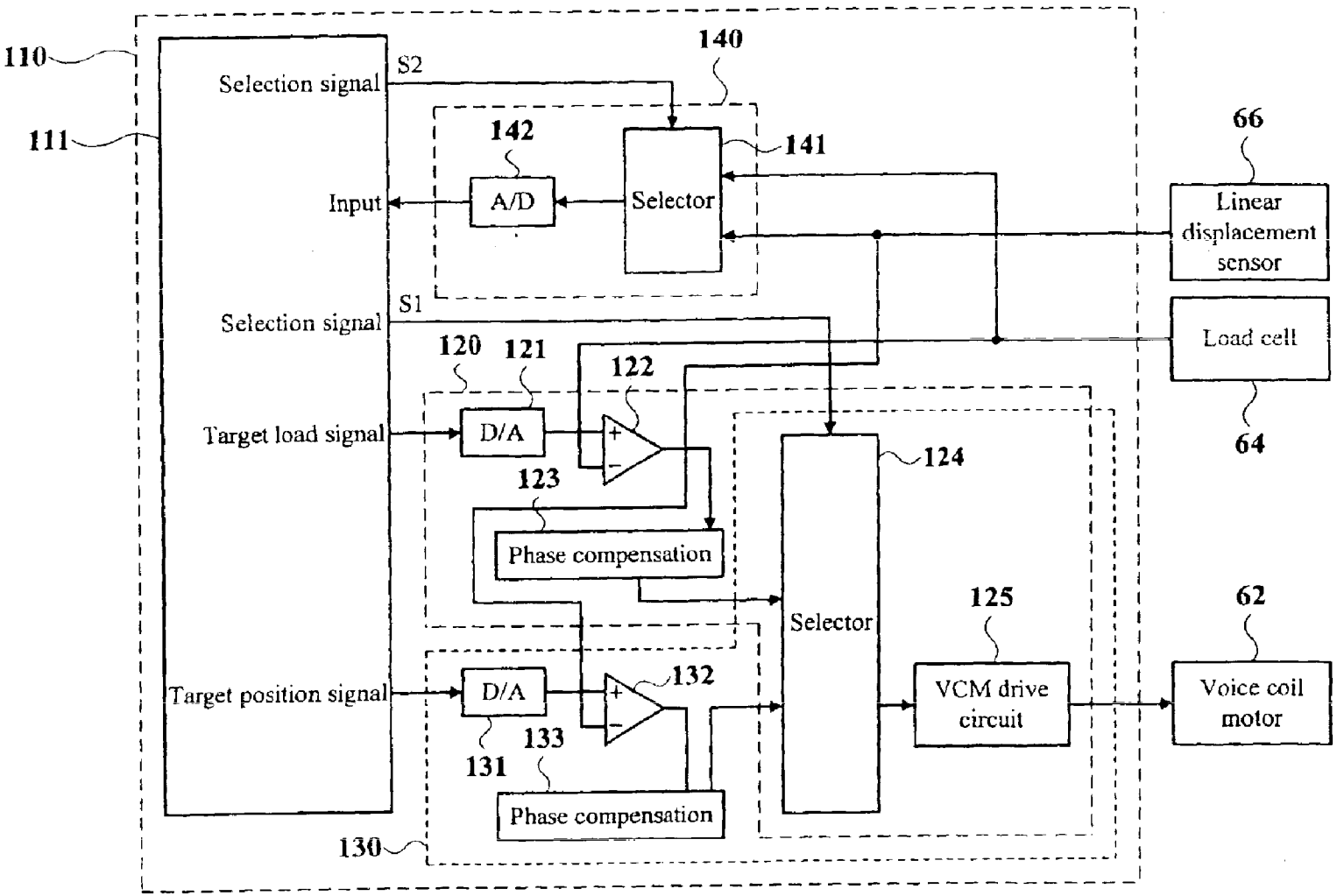
FIG. 10 is a block diagram showing the control circuit of the polishing apparatus shown in FIG. 9.

FIG. 10 is a block diagram showing the control circuit of the polishing apparatus shown in FIG. 9. And FIG. 11 shows an operation sequence of the control circuit shown in FIG. 10. In FIG. 10, only the control circuit for the equipment, which polishes one surface of the magnetic disk 2, is shown in order to simplify the explanation.

The control circuit 110 comprises a logic control circuit 111, a load control circuit 120, a head position control circuit 130 and a detection circuit 140. The load control circuit 120 has a D/A converter 121, a differential amplifier 122, a phase compensation circuit 123, a selector 124 and a VCM drive circuit 125. The head position control circuit 130 has a D/A converter 131, a differential amplifier 132, a phase compensation circuit 133, the selector 124 and the VCM drive circuit 125. The selector 124 and the VCM drive circuit 125 are shared in the load control circuit 120 and the position control circuit 130. The detection circuit 140 has a selector 141, which receives detection signals from the load cell 64 and the linear displacement sensor 66, and an A/D converter 142, which converts the detection signal selected by the selector 141 into the digital data.

The logic control circuit 111 consists of a so-called gate array or a programmable logic device having a microprocessor unit. The logic control circuit 111 switches the load control circuit 120 and the head position control circuit 130 alternatively by generating selection signals, inputs the detection signal detected by each sensor and converted into the digital data from the detection circuit 140, and makes the VCM drive circuit 125 to supply a certain drive current according to the sequence shown in FIG. 11 by generating a target position signal or a target load signal.

An operation of the control circuit 110 will be hereafter explained according to the sequence shown in FIG. 11. First, the control circuit 110 carries out the bias control, in which the tape head 5 is moved from a starting point 0 and positioned at a point HP. Next, the control circuit 110 carries out the positioning control, in which the tape head 5 is moved from the point HP and stopped at a point NP, which is close to the surface of the magnetic disk 2. Then, the control circuit 110 carries out the soft contact control. In the soft contact control, the tape head 5 is moved to a point CP first, so that the abrasive tape 3 touches the surface of the magnetic disk 2. Then, the control circuit 110 turns into the load feedback control when the tape head 5 reaches the point CP, and gradually raises a load up to a final target load. When the load becomes the final target load, the control circuit 110 carries out the target load control and keeps the load. At last, after finishing a polish, the control circuit carries out the shunting control, in which the tape head 5 is positioned at the starting point O and shunted.

In the soft contact control, there are two methods in making the abrasive tape 3 to touch the surface of the magnetic disk 2. One is to position the tape head 5 at a predetermined position, so that the abrasive tape 3 is considered to contact the surface of the magnetic disk 2. Another one is to check a contact of the abrasive tape 3 and the magnetic disk 2 by actually detecting a contact pressure of approximately 50 mN using the load cell 64. The former is taken here for an example and each control will be explained hereafter.

First, in the bias control, the logic control circuit 111 generates selection signals S1, S2 for positioning. The selection signal S1 is a signal that switches the selector 124 from the load control circuit 120 to the head position control circuit 130. The selector 124 selects a signal in the load control circuit 120 when the selection signal S1 is not supplied, and it selects a signal in the head position control circuit 130 when the selection signal S1 is supplied. The selection signal S2 is a signal that switches the selector 141 from the load cell 64 to the linear displacement sensor 66. The selector 141 selects a signal from the load cell 64 when the selection signal S2 is not supplied, and it selects a signal from the linear displacement sensor 66 when the selection signal S2 is supplied.

While generating the selection signals S1, S2, the logic control circuit 111 generates the position data of the point HP as the target position signal. The control circuit 110 becomes a feedback control circuit and generates the drive current that makes a position of the tape head 5 equal to a target position. The target position signal from the logic control circuit 111 is supplied to the VCM drive circuit 125 through the D/A converter 131, the differential amplifier 132, the phase compensation circuit 133 and the selector 124, and the drive current is supplied to the voice coil motor 62 from the VCM drive circuit 125. At this time, the differential amplifier 132 generates a differential signal depending on the difference between the position detection signal from the linear displacement sensor 66 and the target position signal converted by the D/A converter 131. The position detection signal from the linear displacement sensor 66 is input to the logic control circuit 111 through the selector 141 and the A/D converter 142, and monitored. The tape head 5 stops when reaching the point HP.

In the positioning control, the logic control circuit 111 generates the drive signal data of a trapezoid wave as the target position signal while generating the selection signals S1, S2. This target position signal is supplied to the VCM drive circuit 125 through the D/A converter 131, the differential amplifier 132, the phase compensation circuit 133 and the selector 124, and the drive current is supplied to the voice coil motor 62 from the VCM drive circuit 125. At this time, the differential amplifier 132 generates the large differential signal, and the tape head 5 is moved toward the point NP, which is close to the surface of the magnetic disk 2, at high speed. The position detection signal from the linear displacement sensor 66 is input to the logic control circuit 111 through the selector 141 and the A/D converter 142, and monitored. The logic control circuit 111 carries out the stopping control when the tape head 5 reaches the point NP and makes the tape head 5 to once stop at the point NP or a close point beyond it.

In the soft contact control, the logic control circuit 111 first generates the position data of the point CP as the target position signal while generating the selection signals S1, S2. This target position signal is supplied to the VCM drive circuit 125 through the D/A converter 131, the differential amplifier 132, the phase compensation circuit 133 and the selector 124, and the drive current is supplied to the voice coil motor 62 from the VCM drive circuit 125. At this time, the differential amplifier 132 generates the differential signal depending on the difference between the position detection signal from the linear displacement sensor 66 and the target position signal converted by the D/A converter 131. The position detection signal from the linear displacement sensor 66 is input to the logic control circuit 111 through the selector 141 and the A/D converter 142, and monitored.

Here, when the logic control circuit 111 generates the position data of points, which gradually approach the point CP, by many steps instead of the position data of the point CP, the contact becomes softer. However, even if the logic control circuit 111 generates the position data of the point CP and moves the tape head 5 directly to the point CP, the contact can be soft since the distance from the point NP to the point CP is short and the tape head 5 has been once stopped.

Next, the logic control circuit 111 stops generating the selection signals S1, S2 when the tape head 5 reaches the point CP. By this, the selector 124 is switched from the head position control circuit 130 to the load control circuit 120, and the selector 141 is switched from the linear displacement sensor 66 to the load cell 64. A load detection signal from the load cell 64 is input to the logic control circuit 111 through the selector 141 and the A/D converter 142.

The logic control circuit 111 generates the load data, which rises gradually up to the final target load, as the target load signal depending on the load detection signal from the load cell 64. The control circuit 110 becomes a feedback control circuit and generates the drive current that makes the pressuring force of the voice coil motor 62 equal to a target load. The target load signal from the logic control circuit 111 is supplied to the VCM drive circuit 125 through the D/A converter 121, the differential amplifier 122, the phase compensation circuit 123 and a selector 124, and the drive current is supplied to the voice coil motor 62 from the VCM drive circuit 125. At this time, the differential amplifier 122 generates a differential signal depending on the difference between the load detection signal from the load cell 64 and the target load signal converted by the D/A converter 121. And when the pressuring force reaches the target load, the control circuit 110 carries out the target load control and keeps the pressuring force equal to the target load while polishing the magnetic disk 2.

In order to check the contact of the abrasive tape 3 and the magnetic disk 2 by actually detecting the contact pressure using the load cell 64, as mentioned above, the selector 141 should be time division controlled and both the position detection signal from the linear displacement sensor 66 and the load detection signal from the load cell 64 should be input to the logic control circuit 111. Then, the head position control circuit 130 and the load control circuit 120 should operate in parallel, so that the soft contact control and the load control are carried out simultaneously.

Even if such time division control is not carried out, the contact of the abrasive tape 3 and the magnetic disk can be checked by actually detecting the contact pressure using the load cell 64, and the load control can be carried out by monitoring the detection signal from each sensor independently, without employing the selectors 141, 124, and integrating the phase compensation circuits 123, 133. In this case, the contact pressure to be detected will be approximately dozens to ten dozens mN.

The phase compensation circuit 123 mainly consists of a lead/lag filter circuit, which carries out the phase compensation when feeding the detection signal back during the load control. The phase compensation circuit 133 mainly consists of a lead/lag filter circuit, which carries out the phase compensation when feeding the detection signal back during the positioning control.

In the shunting control, the logic control circuit 111 generates the selection signals S1, S2 again and generates the drive signal data of the trapezoid wave for returning to the starting point 0 as the target position signal. This target position signal is supplied to the VCM drive circuit 125 through the D/A converter 131, the differential amplifier 132, the phase compensation circuit 133 and the selector 124, and the drive current is supplied to the voice coil motor 62 from the VCM drive circuit 125. At this time, the differential amplifier 132 generates the large differential signal, and the tape head 5 is moved toward the starting point O at high speed. The position detection signal from the linear displacement sensor 66 is input to the logic control circuit 111 through the selector 141 and the A/D converter 142, and monitored. The logic control circuit 111 carries out the stopping control when the tape head 5 reaches the starting point 0, and makes the tape head 5 to stop at the starting point O or a close point beyond it.

According to this embodiment, since the voice coil motor 62 is driven by generating the target load signal and controlled by feeding the load detection signal from the load cell 64 back to the target load signal, even if the surface of the magnetic disk 2 deflects, the pressuring force of the voice coil motor 62 is finely adjusted in response to a deflection by the feedback control. Therefore, it becomes possible to polish the surface of the magnetic disk 2 uniformly.

Furthermore, according to this embodiment, since the voice coil motor 62 is driven by generating the target load signal, which rises gradually up to the final target load, depending on the load detection signal from the load cell 64 and controlled by generating the target load signal indicating the final target load after that, it becomes possible to prevent the damage generated when the abrasive tape 3 touches the surface of the magnetic disk 2.

Furthermore, according to this embodiment, since the tape head 5 is once stopped at the point, which is close to the surface of the magnetic disk 2, and the contact of the abrasive tape and the magnetic disk is carried out softly, it becomes possible to prevent the damage generated when the abrasive tape 3 touches the surface of the magnetic disk 2.

The sensors for detecting the positions of the tape heads 5 in the present invention are not limited to the linear displacement sensor. Although the voice coil motor is driven forward and backward in this example, the feedback control can be carried out even if the voice coil motor is driven forward only since it receives the repulsion from the magnetic disk in practice. Moreover, although the D/A converter and the differential amplifier are provided in the load control circuit 120 and the head position control circuit 130 respectively in this example, the D/A converter and the differential amplifier may be used in common.

Although the voice coil motor is utilized in the tape head pressuring unit in the examples explained above, the present invention is not limited to this and what is necessary is to generate the pressuring force using the electromagnetic force.

Figure 12:
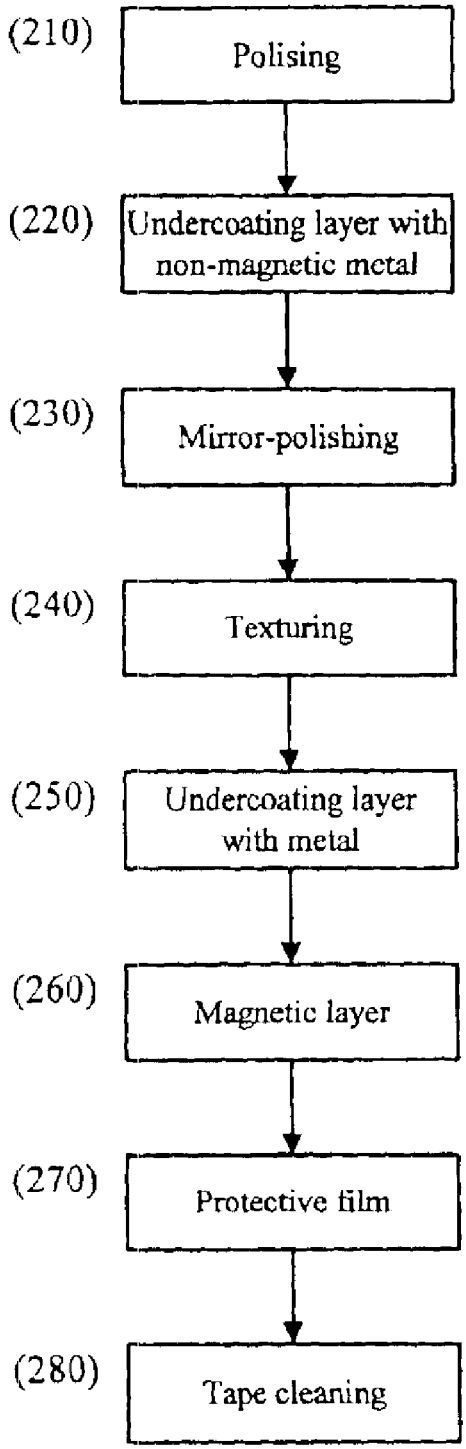
FIG. 12 is a flow chart showing an example of a manufacturing process, that includes the polishing apparatus and method described herein, used in the manufacture of a magnetic disk.

FIG. 12 is a flow chart showing an example of a manufacturing process, including the polishing apparatus and methods described herein, to manufacture a magnetic disk. First, a polishing process is carried out on both surfaces of a substrate, which consists of an aluminum alloy, etc., and its surfaces are mirror-polished so as to have the surface roughness of about 1 nanometer in average (Step 210). Next, undercoating layers with non-magnetic metal, which consist of a nickel-phosphorus (Ni—P) alloy, etc. and whose thickness is about 5–20 micrometers, are formed on the surfaces of the substrate by electroless plating, etc. (Step 220). Then, a mirror-polishing process is carried out and upper layers are polished out about 2–5 micrometers so as to have the surface roughness Ra of about 20–50 angstroms (Step 230). Next, after carrying out a texturing process for making minute grooves (Step 240), undercoating layers with metal, which consist of chromium, copper, NiAl, etc. and whose thickness is about 50–2000 angstroms, are formed by sputtering, etc. (Step 250). Then, magnetic layers, which consist of a ferromagnetic cobalt alloy, etc. and whose thickness is about 100–1000 angstroms, are formed by sputtering, etc. (Step 260). Then, protective films, which consist of a carbon film, a carbon hydride film, a carbon nitride film, etc. and whose thickness is about 10–150 angstroms, are formed (Step 270). After forming the protective films in such a manufacturing process, in order to remove small protrusions generated during these membrane forming processes and in order to clean up the surfaces of the magnetic disk, the tape cleaning is carried out on the surfaces of the magnetic disk (Step 280).

The polishing apparatus and the polishing method according to the present invention are applicable to the polishing process (Step 220), the mirror-polishing process (Step 230) and the tape cleaning (Step 280). However, an object under polish is not limited to the magnetic disk, and the present invention is generally applicable to many things that tend to get the damage during a polish.

We claim:

1. A polishing apparatus comprising:

a rotating unit, which rotates an object under polish, an abrasive tape, which polishes a surface of the object under polish, a tape head, which presses said abrasive tape against the surface of the object under polish, a tape supply unit, which supplies said abrasive tape to said tape head, a tape take-up unit, which takes-up said abrasive tape from said tape head, and a tape head pressuring unit, which pressures said tape head using the electromagnetic force, wherein said tape head pressuring unit has a swing arm, which supports said tape head vertically, and a voice coil motor, which pressures said tape head supported by said swing arm.

2. The polishing apparatus according to claim 1, wherein said tape head comprises a roller.

3. A polishing apparatus comprising:

a rotating unit, which rotates an object under polish, an abrasive tape, which polishes a surface of the object under polish, a tape head, which presses said abrasive tape against the surface of the object under polish, a tape supply unit, which supplies said abrasive tape to said tape head, a tape take-up unit, which takes-up said abrasive tape from said tape head, and a tape head pressuring unit, which pressures said tape head using the electromagnetic force, wherein said tape head pressuring unit has a linear-type voice coil motor with a movable portion that moves in a direction towards the object under polish, and wherein said tape head is connected to the movable portion of said linear-type voice coil motor.

4. The polishing apparatus according to claim 3, wherein said tape head comprises a roller.

5. A polishing apparatus comprising:

a rotating unit, which rotates an object under polish, an abrasive tape, which polishes a surface of the object under polish, a tape head, which presses said abrasive tape against the surface of the object under polish, a tape supply unit, which supplies said abrasive tape to said tape head, a tape take-up unit, which takes-up said abrasive tape from said tape head, and a tape head pressuring unit, which pressures said tape head using the electromagnetic force, wherein said tape head pressuring unit has a rotary-type voice coil motor with a movable portion that rotates, and wherein said tape head is connected to the movable portion of said rotary-type voice coil motor.

6. The polishing apparatus according to claim 5, wherein said tape head comprises a roller.

7. A polishing method comprising the steps of:

rotating an object under polish, supplying and taking-up an abrasive tape to/from a tape head, and pressing said abrasive tape against a surface of the object under polish by pressuring said tape head using electromagnetic force, wherein a voice coil motor is utilized in generating a pressuring force for pressuring said tape head, and said voice coil motor is driven by supplying a certain voltage.

8. The polishing method according to claim 7, wherein said tape head is pressured in a direction approximately right-angled to the direction of the tension applied to said abrasive tape due to the supply and take-up of said abrasive tape.

9. The polishing method according to claim 7, wherein the object under polish is supported and rotated such that the surface to be polished is arranged vertically.

10. The polishing method according to claim 7, wherein said abrasive tape is recovered below the object under polish.

11. A polishing apparatus comprising:

a rotating unit, which rotates an object under polish, an abrasive tape, which polishes a surface of the object under polish, a tape head, which presses said abrasive tape against the surface of the object under polish, a tape supply unit, which supplies said abrasive tape to said tape head, a tape take-up unit, which takes-up said abrasive tape from said tape head, a tape head pressuring unit, which pressures said tape head using a voice coil motor, a sensor, which detects a vibration of said voice coil motor, and a control circuit, which supplies an electric signal that causes said voice coil motor to generate a certain electromagnetic force and adjusts said electric signal depending on a detection signal from said sensor.

12. A polishing apparatus comprising:

a rotating unit, which rotates an object under polish, an abrasive tape, which polishes a surface of the object under polish, a tape head, which presses said abrasive tape against the surface of the object under polish, a tape supply unit, which supplies said abrasive tape to said tape head, a tape take-up unit, which takes-up said abrasive tape from said tape head, a tape head pressuring unit, which pressures said tape head using a voice coil motor, a sensor, which detects a vibration of said voice coil motor, and a control circuit, which adds a high frequency signal to an electric signal that causes said voice coil motor to generate a certain electromagnetic force, supplies the combined signal to the voice coil motor and adjusts said electric signal depending on a detection signal from said sensor.

13. A polishing apparatus comprising:

a rotating unit, which rotates an object under polish, an abrasive tape, which polishes a surface of the object under polish, a tape head, which presses said abrasive tape against the surface of the object under polish, a tape supply unit, which supplies said abrasive tape to said tape head, a tape take-up unit, which takes-up said abrasive tape from said tape head, a voice coil motor, which pressures said tape head, a pressure sensor, which detects a pressuring force of said voice coil motor, and a feedback control circuit, which generates a drive signal for said voice coil motor and adjusts said drive signal depending on a pressure detection signal from said pressure sensor.

14. The polishing apparatus according to claim 13, wherein said feedback control circuit has a target value generating circuit, which generates a signal indicating a target pressuring force, a differential amplifier and a VCM drive circuit, and said differential amplifier receives at its inputs the signal from said target value generating circuit and a pressure detection signal from said pressure sensor and outputs a differential signal to said VCM drive circuit.

15. A polishing apparatus comprising:

a rotating unit, which rotates an object under polish, an abrasive tape, which polishes a surface of the object under polish, a tape head, which presses said abrasive tape against the surface of the object under polish, a tape supply unit, which supplies said abrasive tape to said tape head, a tape take-up unit, which takes-up said abrasive tape from said tape head, a voice coil motor, which moves and pressures said tape head, a position sensor, which detects a position of said tape head, a pressure sensor, which detects a pressuring force of said voice coil motor, a first feedback control circuit, which generates a drive signal for said voice coil motor and adjusts said drive signal depending on a position detection signal from said position sensor, a second feedback control circuit, which generates a drive signal for said voice coil motor and adjusts said drive signal depending on a pressure detection signal from said pressure sensor, and a selector, which selects said first and second feedback circuits alternatively.

16. The polishing apparatus according to claim 15, wherein said first feedback control circuit has the first target value generating circuit, which generates a signal indicating a target position, the first differential amplifier and a VCM drive circuit, said second feedback control circuit has the second target value generating circuit, which generates a signal indicating a target pressuring force, and the second differential amplifier, and shares said VCM drive circuit with said first feedback control circuit, said first differential amplifier inputs the signal from said first target value generating circuit and a position detection signal from said position sensor and outputs the first differential signal to said VCM drive circuit through said selector, and said second differential amplifier inputs the signal from said second target value generating circuit and a pressure detection signal from said pressure sensor and outputs the second differential signal to said VCM drive circuit through said selector.

17. The polishing apparatus according to claim 16, wherein said position sensor is a linear displacement sensor, said first and second target value generating circuits are a logic control circuit generating digital data, said logic control circuit inputs the position detection signal from said linear displacement sensor through a A/D converter and outputs the signal indicating the target position to said first differential amplifier through a D/A converter, and said logic control circuit inputs the pressure detection signal from said pressure sensor through a A/D converter and outputs the signal indicating the target pressuring force to said second differential amplifier through a D/A converter.

18. A polishing method comprising the steps of:

rotating an object under polish, supplying an abrasive tape to a tape head, driving a voice coil motor by generating a signal indicating a target pressuring force so as to pressure said tape head by said voice coil motor, detecting a pressuring force of said voice coil motor, and pressing said abrasive tape against a surface of the object under polish by controlling said voice coil motor with a pressure detection signal fed back to the signal indicating the target pressuring force.

19. The polishing method according to claim 18, wherein said voice coil motor is driven by generating the signal, which rises gradually up to a final target pressuring force, depending on the pressure detection signal and controlled by then generating the signal indicating the final target pressuring force.

20. A polishing method comprising the steps of:

rotating an object under polish, supplying an abrasive tape to a tape head, driving a voice coil motor by generating a signal indicating a first target position so as to move said tape head by said voice coil motor, detecting a position of said tape head, moving said tape head toward a surface of the object under polish and stopping it at a point, which is close to the surface of the object under polish, by controlling said voice coil motor with a position detection signal fed back to the signal indicating the first target position, driving said voice coil motor by generating a signal indicating a second target position so as to move said tape head by said voice coil motor, detecting the position of said tape head, making said abrasive tape to touch the surface of the object under polish by controlling said voice coil motor with the position detection signal fed back to the signal indicating the second target position, driving said voice coil motor by generating a signal indicating a target pressuring force so as to pressure said tape head by said voice coil motor, detecting a pressuring force of said voice coil motor, and pressing said abrasive tape against the surface of the object under polish by controlling said voice coil motor with a pressure detection signal fed back to the signal indicating the target pressuring force.

21. The polishing method according to claim 20, wherein said tape head is moved at high speed until the point, which is close to the surface of the object under polish, and said tape head is moved at low speed when making said abrasive tape touch the surface of the object under polish.

22. The polishing method according to claim 20, wherein the feedback control based on the signal indicating the target position and the position detection signal is switched to the feedback control based on the signal indicating the target pressuring force and the pressure detection signal when said abrasive tape touches the surface of the object under polish or just prior to when said abrasive tape touches the surface of the object under polish.

23. A manufacturing method for a magnetic disk comprising the steps of:

rotating the magnetic disk or its substrate, supplying and taking-up an abrasive tape to/from a tape head, and pressing said abrasive tape against a surface of the magnetic disk or its substrate by pressuring said tape head using electromagnetic force so as to polish the surface of the magnetic disk or its substrate, wherein a voice coil motor is utilized in generating a pressuring force for pressuring said tape head, and said voice coil motor is driven by supplying a certain voltage.

24. A manufacturing method for a magnetic disk comprising the steps of:

rotating the magnetic disk or its substrate, supplying an abrasive tape to a tape head, driving a voice coil motor by generating a signal indicating a target pressuring force so as to pressure said tape head by said voice coil motor, detecting a pressuring force of said voice coil motor, and pressing said abrasive tape against a surface of the magnetic disk or its substrate by controlling said voice coil motor with a pressure detection signal fed back to the signal indicating the target pressuring force so as to polish the surface of the magnetic disk or its substrate.

25. A manufacturing method for a magnetic disk comprising the steps of:

rotating the magnetic disk or its substrate, supplying an abrasive tape to a tape head, driving a voice coil motor by generating a signal indicating a first target position so as to move said tape head by said voice coil motor, detecting a position of said tape head, moving said tape head toward a surface of the magnetic disk or its substrate and stopping it at a point, which is close to the surface of the magnetic disk or its substrate, by controlling said voice coil motor with a position detection signal fed back to the signal indicating the first target position, driving said voice coil motor by generating a signal indicating a second target position so as to move said tape head by said voice coil motor, detecting the position of said tape head, making said abrasive tape to touch the surface of the magnetic disk or its substrate by controlling said voice coil motor with the position detection signal fed back to the signal indicating the second target position, driving said voice coil motor by generating a signal indicating a target pressuring force so as to pressure said tape head by said voice coil motor, detecting a pressuring force of said voice coil motor, and pressing said abrasive tape against the surface of the magnetic disk or its substrate by controlling said voice coil motor with a pressure detection signal fed back to the signal indicating the target pressuring force so as to polish the surface of the magnetic disk or its substrate.

* * * * *